United States Patent [19]

Stitz

[11] Patent Number: 4,589,933

[45] Date of Patent: May 20, 1986

[54] METHOD OF QUENCHING HOT STRIP MILL PRODUCT

[75] Inventor: Walter L. Stitz, Ellicott City, Md.

[73] Assignee: Bethlehem Steel Corporation, Bethlehem, Pa.

[21] Appl. No.: 744,431

[22] Filed: Jun. 13, 1985

[51] Int. Cl.[4] ..... C21D 1/62
[52] U.S. Cl. ..... 148/143
[58] Field of Search ..... 148/143, 153, 156

[56] References Cited

U.S. PATENT DOCUMENTS 3,533,261 10/1970 Hollander et al. ..... 148/156

*Primary Examiner*—R. Dean
*Attorney, Agent, or Firm*—William B. Noll

[57] ABSTRACT

A method of improving the quenched metallurgical qualities of a hot strip mill product quenched with recycled industrial water. The improvement is achieved by coating the throat plates of the quenching station with an oil and grease repellant compound to thereby provide a continuous curtain of such water impacting against the surface of said hot strip mill product.

4 Claims, 1 Drawing Figure

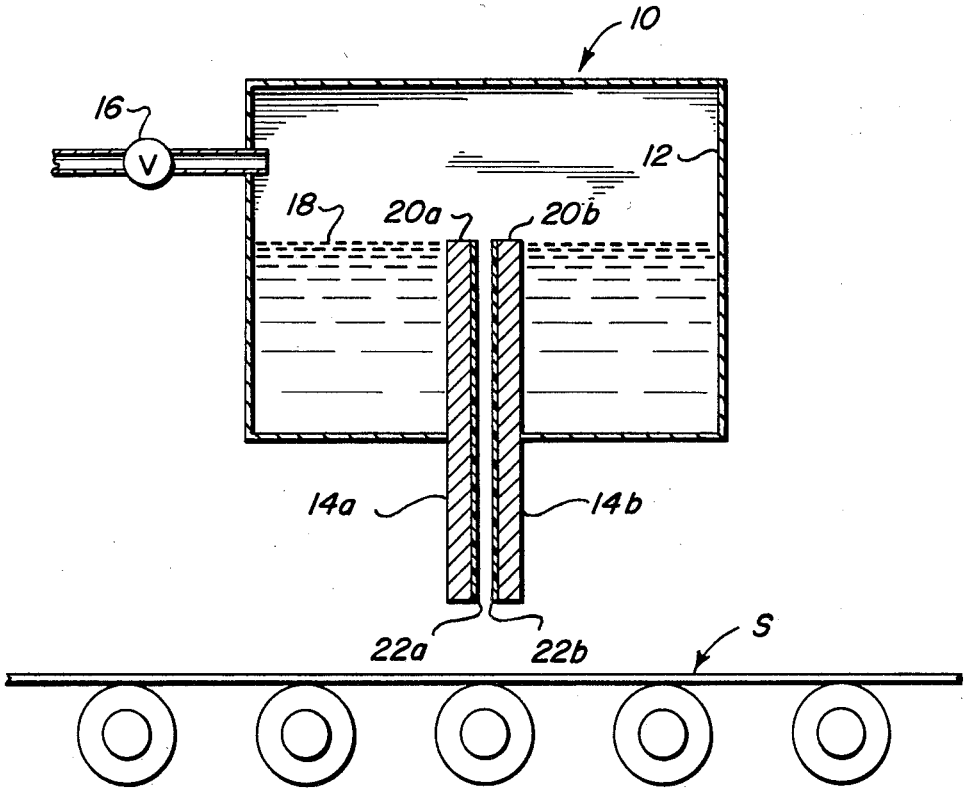
10
16
V
12
18
20a
20b
14a
14b
22a
22b
S

METHOD OF QUENCHING HOT STRIP MILL PRODUCT

BACKGROUND OF THE INVENTION

This invention is directed to the method of improving the transverse, i.e. edge-to-edge, properties of a hot strip mill product, by subjecting such product to a quenching system which generates a continuous curtain of quenchant, where the quenchant is recycled industrial water. While the method of this invention will be applicable to many types of water systems, it is particularly important in this age of conservation and ecological concern to have such a method which can effectively use recycled industrial water and produce the results to be described hereinafter.

Hot strip mills, as are known today, have emerged from simple reversing hand mills to the present time with synchronized tandem mills of from five to seven in number. After the final finishing stand, the most down stream of said tandem mills, the hot strip, moving at a rapid pace, traverses a run-out table to be coiled at the end thereof. To develop desirable metallurgical properties, and to facilitate coiling and handling, it is necessary to apply quenchant, typically in the form of water, to the hot moving strip on the run out table. Since cooling or quenching is a significant property modifying step, it is important that such cooling or quenching be as uniform as possible.

Different methods or systems have been used over the years to quench the hot strip. To use industrial waters, which could readily clog nozzles or spray systems, a water overflow curtain system was developed. Such system is a water box having a pair of stainless steel throat plates projecting therefrom between which such industrial water flows onto the hot strip. With such water the system was only marginally successful.

It will be recalled that if the water supplied to the curtain system is mill recycled industrial water from a scale pit, for example, problems can occur. This water contains a heavy concentration of suspended solids, oils, and varying sizes of mill scale. When this type of water passes between the stainless steel throat plates, several things may happen, namely:

1. the scale etches the highly polished stainless steel plates,
2. the suspended particles adhere to the surface causing the water to split as it passes these deposits, and
3. the oil veins on the smooth steel surface causes the water to track in the grooves, thus producing more splits.

The net effect of the above is a discontinuous curtain of water impacting against the hot strip. This results in variations in cooling rates and non-uniform properties from edge-to-edge, as well as strip end-to-end, and through the thickness of the strip. These problems may be compounded by the fact that for a given order, one or more pairs of throat plates may not be used. As a result, the industrial water contaminants adhering to the plate surfaces harden to produce new sources of problems during subsequent use.

The method of this invention is based on the recognition of the source of the problem and the means to overcome such problem. The answer, and the repeatability of results from such method, will become apparent from the specification which follows.

BRIEF DESCRIPTION OF DRAWING

The FIGURE is a schematic sectional view of a quenching system used to practice the method of this invention.

DETAILED DESCRIPTION

In the preferred practice of this invention, a hot strip mill product, typically continuous steel strip, is subjected to one or more quenching operations to improve the properties thereof, and to facilitate handling. Referring to the drawing in detail, a moving metal steel strip S, which has been heated and the product of a plurality of reducing steps, passes beneath a quenching station 10 where strip S is subjected to a continuous curtain of quenchant, typically recycled industrial water. The station 10 comprises a reservoir 12, a pair of spaced apart throat plates 14*a*, 14*b* providing communication with the atmosphere. The reservoir 12 is continuously fed by valve 16. When the quenchant level 18 exceeds the throat plate top edges 20*a*, 20*b*, the quenchant flows over the edges 20*a*, 20*b* and cascades down the sides 22*a*, 22*b*.

To insure that adequate quenchant is delivered to the strip, the width of plates 14*a*, 14*b* should exceed the maximum width of strip S to be processed. For example, for a 68" hot strip mill, where such dimension represents the mill capacity, a plate width of 70" will suffice. A typical vertical dimension would be 12". While the spacing between plates 14*a*, 14*b* can be varied, a suitable spacing is approximately ½".

Without the treatment of the throat plates according to this invention, it was not unusual to see "finger splits" develop within 20 minutes of operation. Further, with time, such splits would become amplified to as much as 12 to 15". As a consequence, the quenchant did not impact uniformly against the surface of strip S causing objectionable variations in edge-to-edge properties.

By the method of this invention, finger splits and nonuniformity of strip properties were drastically reduced to the point of near elimination. However, in order to effectively practice the method of this invention, the sides 22*a*, 22*b* are provided with a coating of an oil and grease repellant compound, such as Teflon, a trademark of E. I. DuPont DeNemours & Company, for a synthetic fluorine-containing resin.

It will be understood that there typically are a number of such quenching stations for a given hot strip mill, and that the particular steel order being rolled determines the number of stations placed in operation to meet the specified cooling rate.

To demonstrate the suitability of this invention to improve the metallurgical properties of a hot strip mill product, rimmed steel slabs (Al added to control rimming action) were hot rolled to strip form on a conventional hot strip mill. The slabs were divided into two series with Set A being processed by the use of six (6) quenching stations according to this invention, and Set B processed by six (6) quenching stations according to the prior art. The metallurgical observations are described in Table I.

TABLE I

| Observation | Set A | Set B |
|---|---|---|
| Grain size (grains/sq. in.) | No duplex structure<br>T,B - 325 to 600<br>C - 625 to 750 | Duplex across width<br>T,B - 50 to 300 |

TABLE I-continued

| Observation | Set A | Set B |
|---|---|---|
| | | C - 200 to 600 |

where:

T=top

B=bottom

C=core or center

Surprisingly, the grain size was much finer and more uniform than expected by the use of the quenching stations of this invention. It is now possible to control hot strip properties within narrower limits, and to assure repeatability of results from hot band to hot band.

I claim:

1. In a method of improving the metallurgical properties of a hot strip band subjected to quenching by the application thereto of recycled industrial water containing heavy concentration of suspended solids, oil and mill scale, including the steps of providing a hot strip run-out table having a plurality of quenching stations above said table, where each said station includes a reservoir for said water and a pair of vertically aligned, spaced-apart throat plates arranged to channel such water from the reservoir to said strip passing over said run-out table, the improvement comprising in combination therewith the step of providing a continuous curtain of such water flowing from said throat plates to said strip, where said continuous curtain is maintained by having the major inner surface of each said throat plate coated with a resinous compound characterized by the ability to repel oil and grease.

2. The method according to claim 1 wherein the coating on said major inner surface is formed of a synthetic fluorine-containing resin.

3. The method according to claim 1 wherein said hot strip band is steel characterized by the absence of a duplex structure.

4. The method according to claim 3 wherein the core of said band has a fine grain size of between about 625 and 750 grains per square inch.

* * * * *